US010100628B2

(12) United States Patent
Mouget et al.

(10) Patent No.: US 10,100,628 B2
(45) Date of Patent: Oct. 16, 2018

(54) ROTATING DOWNHOLE LOGGING TOOL WITH REDUCED TORQUE

(71) Applicant: Schlumberger Technology Corporation, Sugar land, TX (US)

(72) Inventors: Pierre Mouget, Sèvres (FR); Henri Denoix, Chatenay-Malabry (FR); Andrew J. Parry, Bourg la Reine (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 521 days.

(21) Appl. No.: 14/718,029

(22) Filed: May 20, 2015

(65) Prior Publication Data

US 2015/0354340 A1 Dec. 10, 2015

(30) Foreign Application Priority Data

Jun. 4, 2014 (EP) ..... 14290161

(51) Int. Cl.
*E21B 47/00* (2012.01)
*E21B 47/01* (2012.01)
*E21B 21/00* (2006.01)

(52) U.S. Cl.
CPC ..... *E21B 47/00* (2013.01); *E21B 21/00* (2013.01); *E21B 47/01* (2013.01)

(58) Field of Classification Search
CPC ..... E21B 47/00; E21B 47/01
See application file for complete search history.

(56) References Cited

U.S. PATENT DOCUMENTS

2008/0115575 A1 5/2008 Meek et al.
2008/0142215 A1 6/2008 Pabon et al.
2012/0273270 A1 11/2012 Rasheed

FOREIGN PATENT DOCUMENTS

WO 9812417 A1 3/1998

OTHER PUBLICATIONS

Extended European Search Report issued in the related EP Application 14290161.0, dated Dec. 5, 2014 (7 pages).

*Primary Examiner* — Caroline N Butcher
(74) *Attorney, Agent, or Firm* — Michael Dae

(57) ABSTRACT

Systems and methods for reducing torque on a rotating downhole logging tool are provided. In one embodiment, a downhole logging tool is provided. The downhole logging tool may include a support element, which may include a hollow cavity. The support element may be configured to rotate about an axis when the support element is inserted in a well, and the hollow cavity may be configured to permit fluid flow through the support element when the support element is in the well. Furthermore, the downhole logging tool may include a first fairing portion, which may include a first sensor to obtain measurements in the well. Additionally, the first fairing portion may be configured to form a revolution surface associated with a portion of the support element.

19 Claims, 7 Drawing Sheets

ROTATING DOWNHOLE LOGGING TOOL WITH REDUCED TORQUE

FIELD OF THE DISCLOSURE

The disclosure generally relates to downhole tools, and more particularly relates to a systems and methods for reducing torque on a rotating downhole logging tool.

BACKGROUND

When a well is drilled into a geological formation, logging tools are used to determine a variety of characteristics of the well. Some logging tools may determine characteristics of the surrounding rock formation. Other logging tools may determine when cement has been properly installed in the well to achieve zonal isolation. Still other logging tools may measure characteristics of one or more fluids present in the well.

In certain cases, a logging tool may be configured to rotate while obtaining measurements in the well. However, the presence of fluids in the well may result in the logging tool experiencing fluidic resistance, thereby increasing the driving torque for rotating the logging tool while in the well.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

Embodiments of the disclosure relate to systems and methods for reducing torque on a rotating downhole logging tool. According to one or more embodiments of the disclosure, a downhole logging tool is provided. In one example, a downhole logging tool may include a support element, which may include a hollow cavity. The support element can rotate about an axis when the support element is inserted in a well, and the hollow cavity can permit fluid flow through the support element when the support element is in the well. Furthermore, the downhole logging tool may include a first fairing portion, which may include a first sensor to obtain measurements in the well. Additionally, the first fairing portion can form a revolution surface associated with a portion of the support element to reduce fluidic resistance of the rotating support element.

According to one or more other embodiments of the disclosure, a system is provided. In one example, a system may include data processing circuitry. Additionally, the system may also include a logging tool. The logging tool may include a support element, which may include a hollow cavity. The support element can rotate about an axis when the support element is inserted in a well, and the hollow cavity can permit fluid flow through the support element when the support element is in the well. Furthermore, the logging tool may include a first fairing portion, which may include a first sensor to obtain measurements in the well. Additionally, the first fairing portion can form a revolution surface associated with a portion of the support element to reduce fluidic resistance of the rotating support element.

According to one or more other embodiments of the disclosure, a method is provided. In one example, a method may include providing a logging tool with one or more sensors. The tool may include one or more revolution surfaces that can reduce fluidic resistance of the tool when the tool is within a well. Additionally, fluid may flow through the tool when the tool is in the well. The method may also include inserting the tool in the well and rotating the tool in the well. Furthermore, the method may include receiving measurements from the one or more sensors within the well.

Various refinements of the features noted above may be made in relation to various aspects of the disclosure. Further features may also be incorporated in these various aspects as well. These refinements and additional features may exist individually or in any combination. For instance, various features discussed below in relation to one or more of the illustrated embodiments may be incorporated into any of the above-described aspects of the disclosure alone or in any combination. The brief summary presented above is intended just to familiarize the reader with certain aspects and contexts of embodiments of the disclosure without limitation to the claimed subject matter.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

Figure 1A:
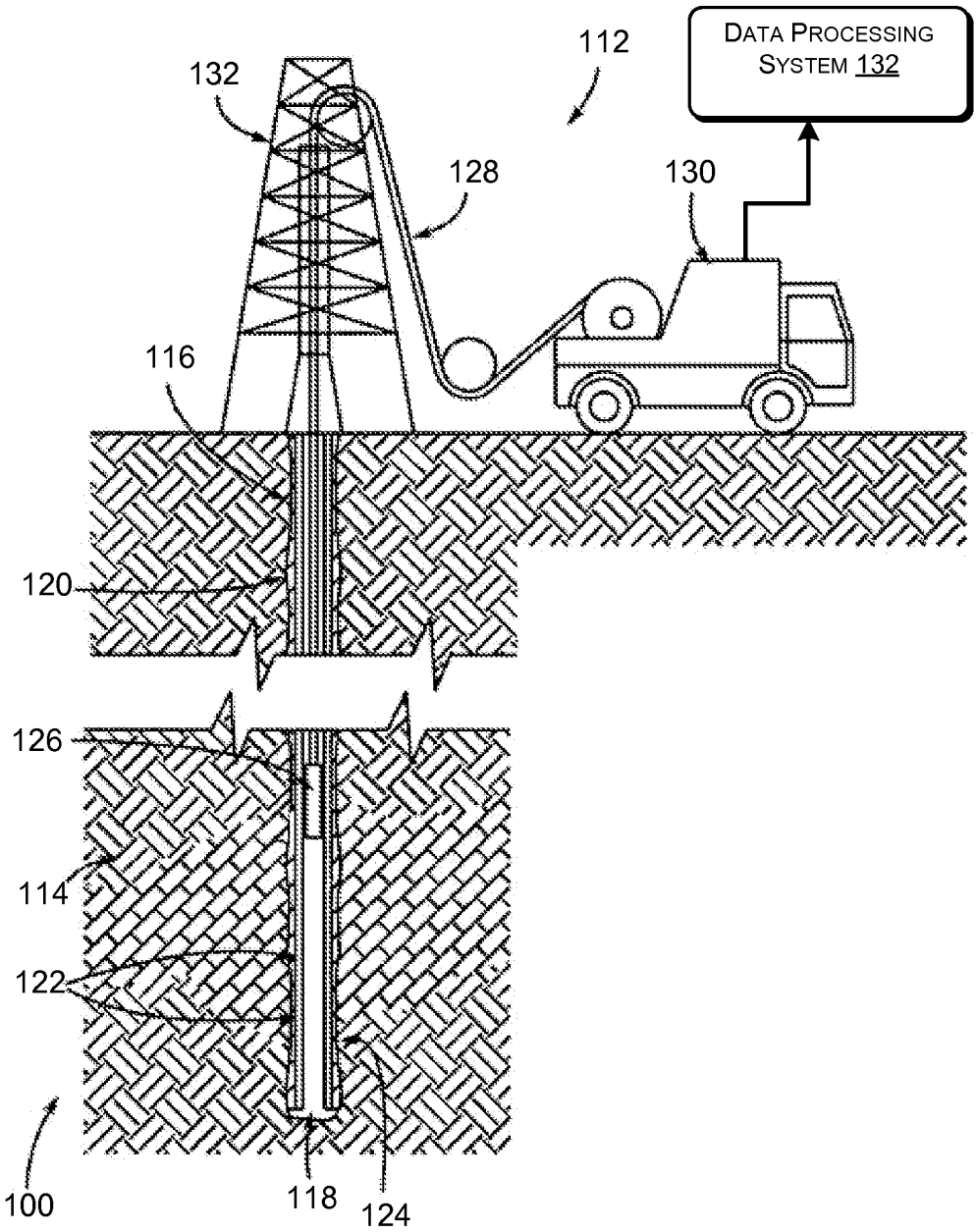
FIG. 1A illustrates an example system for a rotating downhole logging tool with reduced torque in accordance with one or more example embodiments.

Certain implementations will now be described more fully below with reference to the accompanying drawings, in which various implementations and/or aspects are shown. However, various aspects may be implemented in many different forms and should not be construed as limited to the implementations set forth herein; rather, these implementations are provided so that this disclosure will be thorough and complete, and will fully convey the scope of the disclosure to those skilled in the art. Like numbers in the figures refer to like, but not necessarily the same or identical, elements throughout. Hence, if a feature is used across several drawings, the number used to identify the feature in the drawing where the feature first appeared will be used in later drawings.

DETAILED DESCRIPTION

Overview

Described herein are various implementations related to a rotating wireline logging tool with a reduced torque. Broadly, the systems and methods described herein may describe a logging tool configured to obtain measurements while moving through fluid in a well. The logging tool may include certain features configured to reduce an amount of driving torque used to rotate the logging tool while obtaining the measurements in the well. The reduction of torque on the logging tool can improve measurement data received by or otherwise obtained from the logging tool.

These and other embodiments of the disclosure will be described in more detail through reference to the accompanying drawings in the detailed description of the disclosure that follows. This brief introduction, including section titles and corresponding summaries, is provided for the reader's convenience and is not intended to limit the scope of the claims or the proceeding sections. Furthermore, the techniques described above and below may be implemented in a number of ways and in a number of contexts. Several example implementations and contexts are provided with reference to the following figures, as described below in more detail. However, the following implementations and contexts are but a few of many.

Illustrative Embodiments

FIG. 1 schematically illustrates an example well-logging system 100 in accordance with one or more example embodiments. In particular, FIG. 1 illustrates surface equipment 112 above a geological formation 114. In the example of FIG. 1, a drilling operation has previously been carried out to drill a wellbore 116, to run a casing string 118, and to seal an annulus 120—the space between the wellbore 116 and the casing string 118—with cementing operations.

The casing string 118 may include several casing joints 122 (also referred to below as casing 122) coupled together by casing collars 124 to stabilize the wellbore 116. The casing joints 122 represent lengths of conductive pipe, which may be formed from steel or similar materials. In one example, the casing joints 122 each may be approximately 13 meters or 40 feet long, and may include an externally threaded (male thread form) connection at each end. A corresponding internally threaded (female thread form) connection in the casing collars 124 may connect two nearby casing joints 122. Coupled in this way, the casing joints 122 may be assembled to form the casing string 118 to a suitable length and specification for the wellbore 116. The casing joints 122 and/or collars 124 may be made of carbon steel, stainless steel, or other suitable materials to withstand a variety of forces, such as collapse, burst, and tensile failure, as well as chemically aggressive fluid.

The surface equipment 112 may carry out various well logging operations to detect and/or inspect for corrosion, cement bonding with respect to casing, casing centricity, and/or other conditions related to the wellbore 116 or components thereof. The well logging operations may measure parameters of the geological formation 114 (e.g., resistivity or porosity) and/or the wellbore 116 (e.g., temperature, pressure, fluid type, or fluid flowrate). Some measurements may obtained by a downhole logging tool 126, for which various embodiments are described herein. In certain embodiments, the logging tool 126 may include one or more features and/or characteristics that may reduce the driving torque used to rotate the logging tool 126 while placed in the wellbore 116. For example, as described in more detail with reference to FIG. 2A, FIG. 2B, and FIG. 3, the features associated with the logging tool 126 may be configured to reduce fluidic resistance experienced by the logging tool 126 in the wellbore 116. Additionally, the example of FIG. 1 shows the logging tool 126 being conveyed through the wellbore 116 by a cable 128. Such a cable 128 may be a mechanical cable, an electrical cable, or an electro-optical cable that includes a fiber line protected against the harsh environment of the wellbore 116. In other examples, however, the logging tool 126 may be conveyed using any other suitable conveyance, such as coiled tubing or a borehole assembly (BHA) used for logging while drilling (LWD).

Figure 1B:
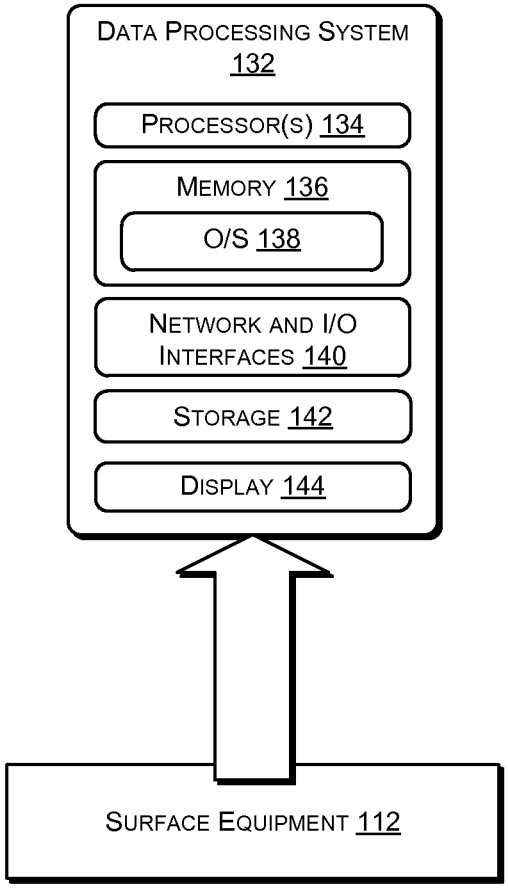
FIG. 1B illustrates a block diagram of an example data processing system in accordance with one or more example embodiments.

According to one or more embodiments, when the downhole logging tool 126 provides measurements to the surface equipment 112 (e.g., through the cable 128), the surface equipment 112 may pass the measurements as logging data to a data processing system 132, which is illustrated in more detail in FIG. 1B. The data processing system 132 may be configured to perform various operations using the logging data, such as executing testing applications, simulations, data reporting, event forecasting and/or the like. As shown in FIG. 1B, the data processing system 132 may include one or more processors 134, a memory 136 storing an operating system (0/S) 138, network and input/output (I/O) interfaces 140, storage 142, and a display 144.

The computer processors 134 may include one or more cores and may be configured to access and execute (at least in part) computer-readable instructions stored in the memory 136. The one or more computer processors 134 may include, without limitation: a central processing unit (CPU), a digital signal processor (DSP), a reduced instruction set computer (RISC), a complex instruction set computer (CISC), a microprocessor, a microcontroller, a field programmable gate array (FPGA), or any combination thereof. The data processing system 132 may also include a chipset (not shown) for controlling communications between the one or more processors 134 and one or more of the other components of the data processing system 132. In certain embodiments, the data processing system 132 may be based on an Intel® architecture or an ARM® architecture, and the processor(s) and chipset may be from a family of Intel® processors and chipsets. The one or more processors 134 may also include one or more application-specific integrated circuits (ASICs) or application-specific standard products (ASSPs) for handling specific data processing functions or tasks.

The memory 136 may include one or more computer-readable storage media (CRSM). In some embodiments, the memory 136 may include non-transitory media such as random access memory (RAM), flash RAM, magnetic media, optical media, solid state media, and so forth. The memory 136 may be volatile (in that information is retained while providing power) or non-volatile (in that information is retained without providing power). Additional embodiments may also be provided as a computer program product including a transitory machine-readable signal (in compressed or uncompressed form). Examples of machine-readable signals include, but are not limited to, signals carried by the Internet or other networks. For example, distribution of software via the Internet may include a transitory machine-readable signal. Additionally, the memory 136 may store an operating system 138 that includes a plurality of computer-executable instructions that may be implemented by the computer processor to perform a variety of tasks to operate the interface(s) and any other hardware installed on the data processing system 132. The memory 136 may also store content that may be displayed by the data processing system 132 or transferred to other devices (e.g., headphones) to be displayed or played by the other devices. The memory 136 may also store content received from the other devices. The content from the other devices may be displayed, played, or used by the data processing system 132 to perform any tasks or operations that may be implemented by the computer processor or other components in the data processing system 132.

The memory 136 may also include an operating system (O/S) 138, which may provide an interface between other application software executing on the same system and/or platform and hardware resources of the data processing system 132. More specifically, the operating system 138 may include a set of computer-executable instructions for managing hardware resources of the data processing system 132 and for providing common services to other application programs (e.g., managing memory allocation among various application programs). The operating system 138 may include any operating system now known or which may be developed in the future including, but not limited to, any consumer operating system, any server operating system, any mainframe operating system, or any other proprietary or freely available operating system.

The one or more network and I/O interfaces 140 may include one or more communication interfaces or network interface devices to provide for the transfer of data between the data processing system 132 and another device (e.g., network server) via one or more networks. The communication interfaces may include, but are not limited to: personal area networks (PANs), wired local area networks (LANs), wireless local area networks (WLANs), wireless wide area networks (WWANs), and so forth. The data processing system 132 may be coupled to the network via a wired or wireless connection. The communication interfaces may utilize acoustic, radio frequency, optical, or other signals to exchange data between the data processing system 132 and another device, such as an access point, a host computer, a server, a router, a reader device, and the like. The networks may include, but are not limited to, the Internet, a private network, a virtual private network, a wireless wide area network, a local area network, a metropolitan area network, a telephone network, and so forth.

The display 144 may include, but is not limited to, a liquid crystal display, a light-emitted diode display, or an E-Ink™ display. The display 144 may be used to show content to a user in the form of text, images, or video. In certain instances, the display 144 may also operate as a touch screen display that may enable the user to initiate commands or operations by touching the screen using certain finger or hand gestures.

Figure 2A:
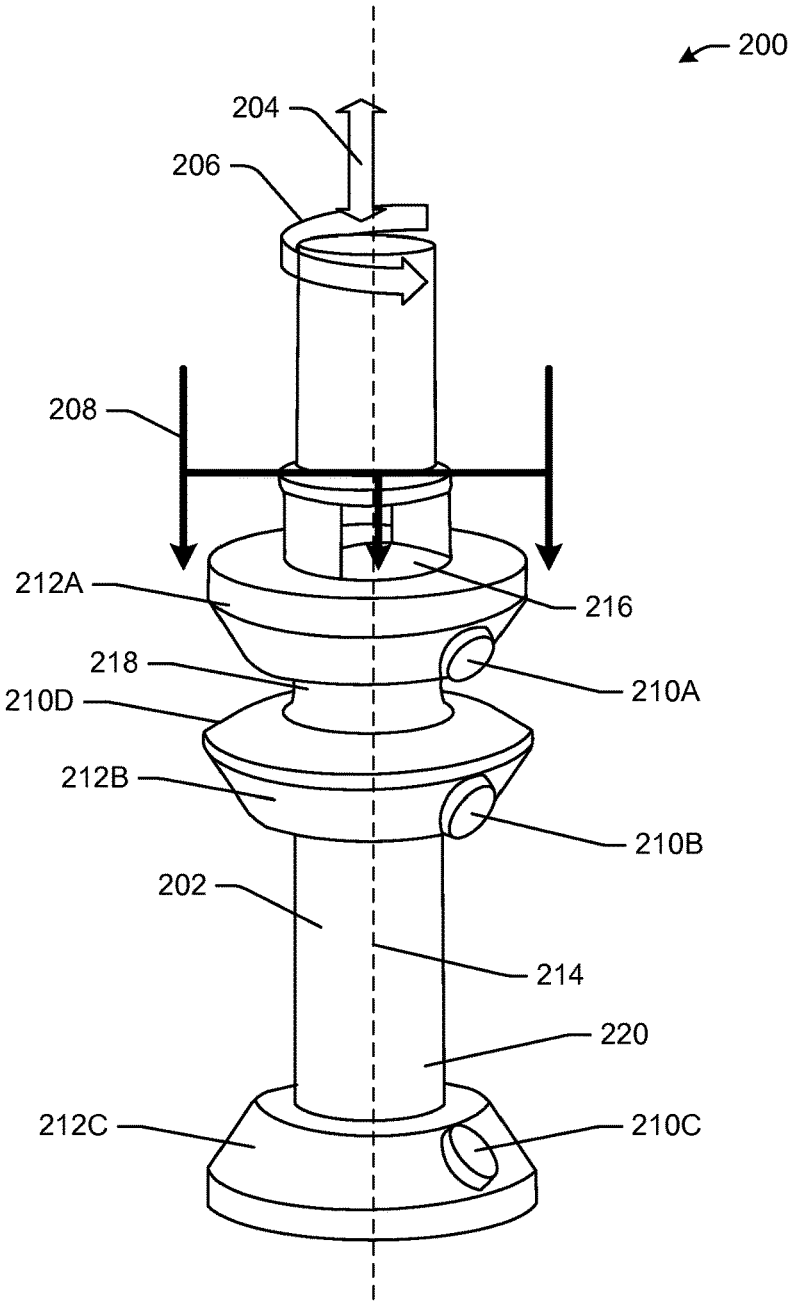
FIG. 2A illustrates a schematic diagram of an example rotating downhole logging tool in accordance with one or more example embodiments.

Referring now to FIG. 2A, a schematic view of an example logging tool 200 is illustrated in accordance with one or more example embodiments. The logging tool 200 may be an example implementation of the logging tool 126 illustrated in FIG. 1A. In certain implementations, the logging tool 200 may be configured to move in a direction indicated by movement arrow 204 throughout a wellbore (e.g., up and down in the wellbore 116). Furthermore, the logging tool 200 may be configured to rotate in a rotation direction 206 about an axis 214. While FIG. 2A may depict the rotation 206 as a counter-clockwise motion, a clockwise motion and/or or any other rotation direction are also contemplated. Furthermore, while FIG. 2A may depict the flow direction 208 of fluid in the wellbore 116 as substantially downward, it will be understood that the fluid may flow in other directions as well.

The logging tool 200 may also include a support element 202, which may support various components, such as one or more sensors 210A-210C and one or more corresponding fairings portions 212A-212C. The support element 200 may be of a cylindrical shape, and the fairing portions 212A-212C may form respective revolution surfaces associated with at least a portion of the support element 202. In some embodiments, the fairing portions 212A-212C may form respective revolution surfaces around the support element 202. The revolution surfaces of the fairing portions 212A-212C may be shaped such that fluidic forces acting on the structural combination of the sensors 210A-210C and the fairing portions 212A-212C may be relatively shear, tangential, and/or indirect in nature and may reduce fluidic resistance to the rotation of the support element. As shown in FIG. 2A, one or more of the fairing portions 212A-212C may be frustoconical in shape. Additionally, the sensors 210A-210C may be coupled to the fairing portions 212A-212C. A fourth sensor 210D may also be coupled to fairing portion 212B, though the sensor 210D may not be visible in the view provided in FIG. 2A. In certain implementations, the sensors 210A-210C may be substantially embedded within the fairing portions 212A-212C and/or included as part of the fairing portions 212A-212C. It will be appreciated that while the support element 202 is depicted as cylindrical in shape, other shapes with respect to the support element 202 are also contemplated, such as conical, frustoconical, pyramidal, or any other geometrically or symmetrically shaped body. Moreover, while the fairing portions 212A-212C are depicted as frustoconical in shape, other shapes are contemplated, such as conical, cylindrical, pyramidal, or any other geometrically or symmetrically shaped body. Furthermore, it will be appreciated that any number of fairing portions may be coupled to the support element 202, and any number of sensors may be coupled to any number of the fairing portions.

In view of the components described above, the logging tool 200 of FIG. 2A may be configured to reduce fluidic resistance while in a wellbore. For example, coupling the sensors 210A-210C to the fairing portions 212A-212C may cause fluidic forces in the wellbore to act tangentially on the revolution surface(s) formed by the fairing portions 212A-C. As such, the fluidic forces acting on the structural combination of the sensors 210A-210C and the fairing portions 212A-212C may be of a relatively shear and/or indirect in nature. Thus, the amount of driving torque employed to rotate the logging tool 200 in the wellbore may be decreased. Furthermore, the coupling of the sensors 210A-210C and the fairing portions 212A-212C may also reduce drag experienced by the logging tool 200 when moving though the wellbore 116. As a result, the amount of energy used may be reduced, and the overall efficiency may be increased, with respect to operating the logging tool 200, thus resulting in certain technical effects.

According to one or more embodiments, the support element 202 may also include a hollow cavity. To this end, an upper portion 218 of the support element 202 may include an opening 216 by which fluid in the wellbore 116 may be allowed to enter and flow into the hollow cavity. Additionally, the support element 202 may include a lower portion 220, which may be closed and/or sealed (e.g., by fairing portion 210C) although in other implementations, the lower portion 220 may also include an opening similar to the upper portion 218. As a result of allowing fluid flow into the hollow cavity of the support element 202, the blockage effect caused by the logging tool 200 in the wellbore (e.g., wellbore 116) may be reduced. For instance, by having the hollowing cavity in the support element 202, the speed of fluid flowing in the annulus (e.g., annulus 120 of FIG. 1A) between the logging tool 200 and the wellbore (e.g., wellbore 116) may be reduced when compared to the speed of the fluid flowing in the annulus 120 if the support element 202 was not hollow. The reduced speed of the fluid flowing in the annulus 120 may provide another means by which the driving torque used to rotate the logging tool 200 (e.g., the support element 202) in the wellbore 116 may be decreased, thus resulting in certain technical effects.

In certain embodiments, the length of the support element 202 may be approximately 425 millimeters (mm). Additionally the diameter of the support element 202 may be approximately 185 mm, and the diameter of the fairing portion may be approximately 265 mm. Furthermore, the thickness of the support element 202 may be approximately 1.0 mm to 1.5 mm.

Figure 2B:
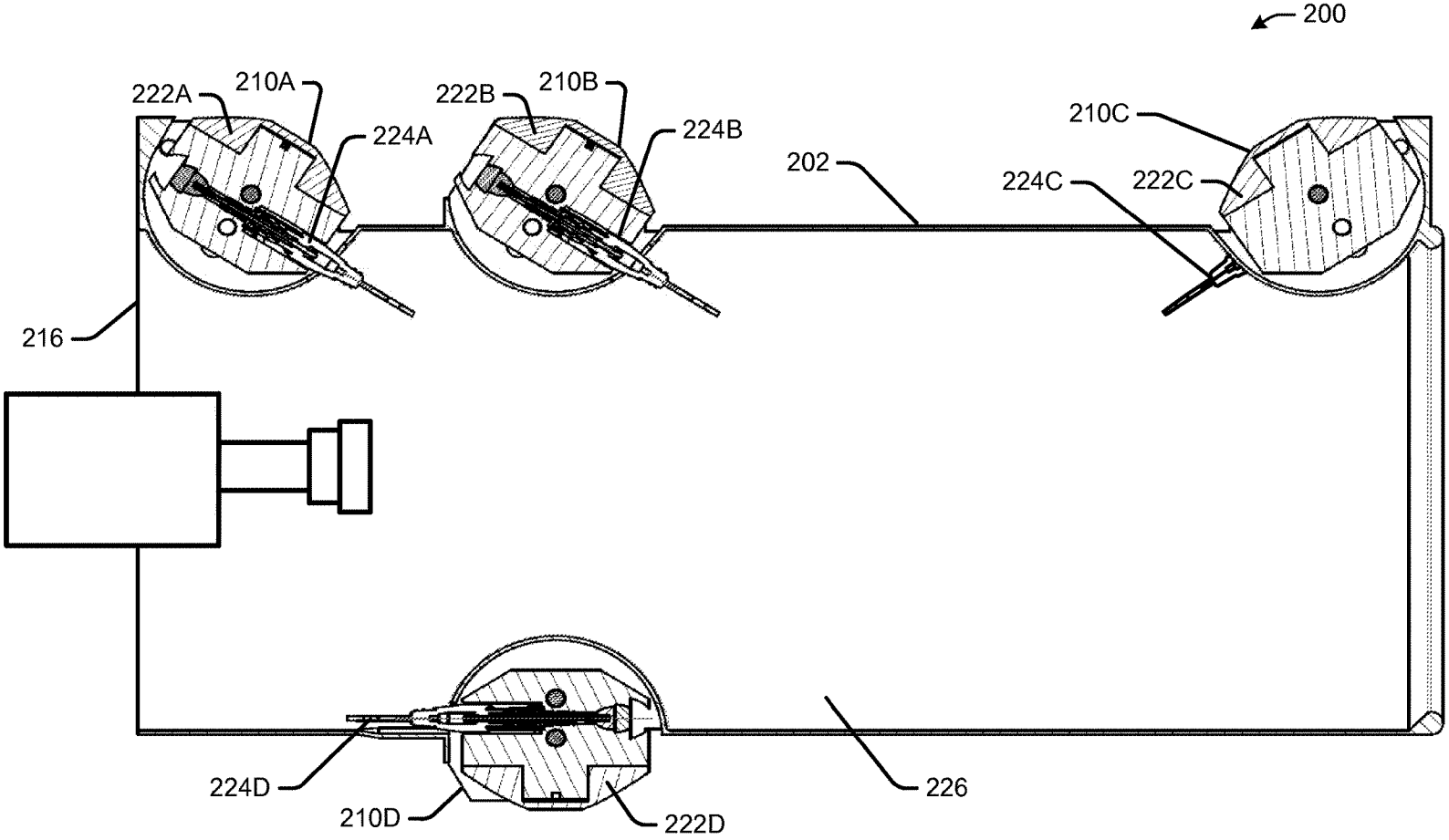
FIG. 2B illustrates a schematic view of the example rotating downhole logging tool in FIG. 2A in accordance with one or more example embodiments.

FIG. 2B provides a schematic cross-sectional view of the logging tool 200 of FIG. 2A in accordance with one or more example embodiments. As shown, the sensors 210A-210D may each include respective sensor housings 222A-222D for respective sensor components 224A-224D. Furthermore, sensors 210B and 210D may be coupled to the same fairing portion (e.g., fairing portion 212B). The sensor housings 222A-222D may be configured to hold and stabilize the sensor components 224A-224D, while the sensor components 224A-224D may be configured to obtain measurements while the logging tool 200 is in the wellbore 116. In certain implementations, the sensors 210A-210D may be configured to at least partially protrude into the hollow cavity 226 of the support element 216. These protrusions may be configured to reduce side forces on the support element 202 that may occur as a result of rotating the support element 202 in the wellbore 116, thus resulting in certain technical effects.

Figure 3:
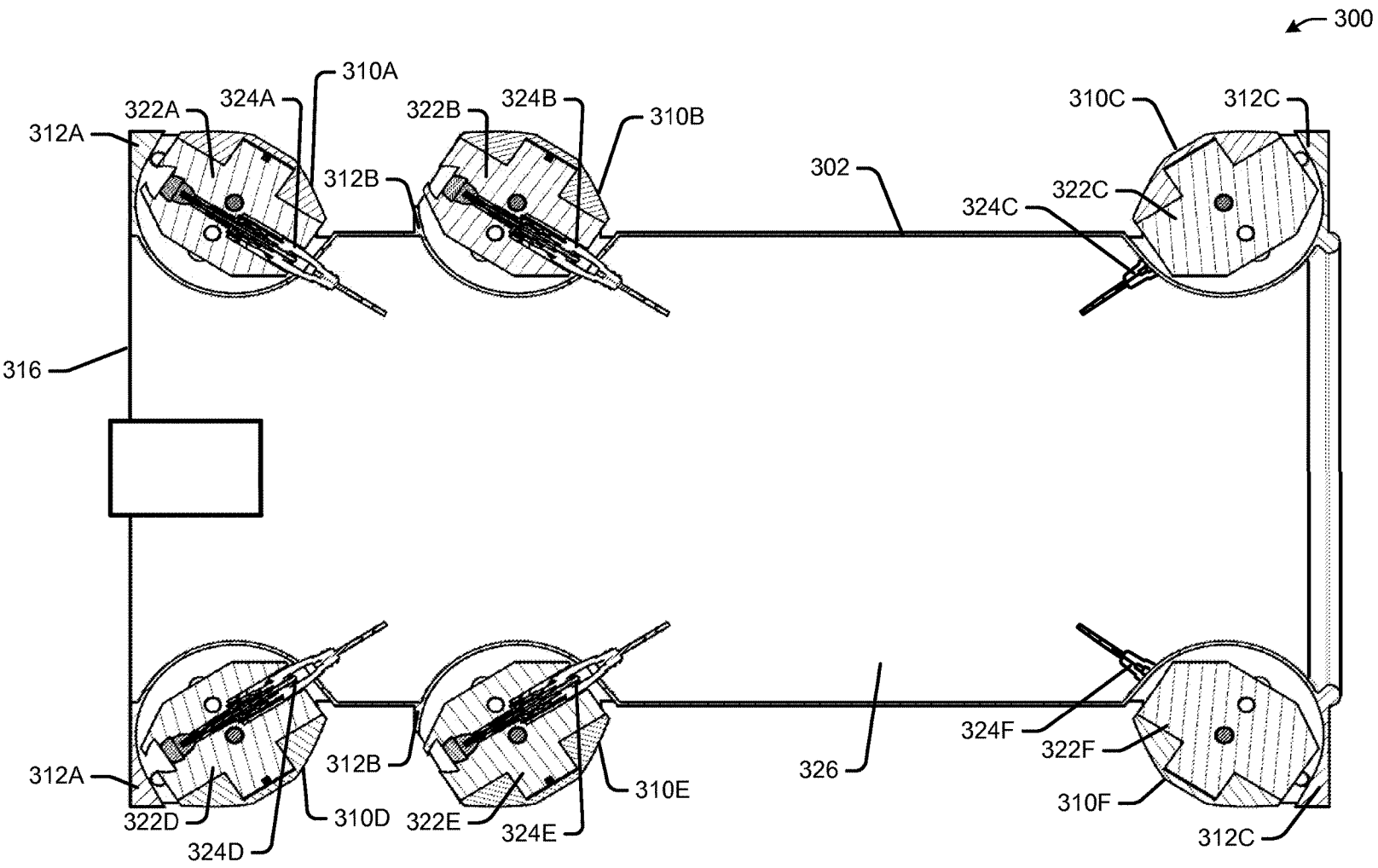
FIG. 3 illustrates a schematic view of another example rotating downhole logging tool in accordance with one or more example embodiments.

Referring now to FIG. 3, a schematic diagram of another logging tool 300 is provided in accordance with one or more example embodiments. In certain implementations, the logging tool 300 may be similar to the logging tool 200 illustrated in FIG. 2A-2B. However, the logging tool 300 may include six sensors 310A-310F. The sensors 310A-310F may include respective sensors housings 322A-322F, which may be configured to house respective sensor components 324A-324F. To this end, the sensor housings 322A-322F may be configured to hold and stabilize the sensor components 324A-324F, while the sensor components 324A-324F may be configured to obtain measurements while the logging tool 300 is in the wellbore (e.g., wellbore 116).

Additionally, the support element 302 may support fairing portions 312A-312C, which may each be coupled to a pair of sensors 310A-310F. For instance, sensors 310A and 310B may be coupled to fairing portion 312A, sensors 310C and 310D may be coupled to fairing portion 312B, and sensors 310E and 310F may be coupled to fairing portion 312C. Furthermore, each of the sensor pairs may be located on opposing surfaces of their respective fairing portions 312A-312C. In some embodiments, the sensor pairs may be located symmetrically across the surfaces of the respective fairing portions 312A-312C (e.g., symmetrically across the hollow cavity 326 of the support element 302). Moreover, the sensors 310A-310F may also at least partially protrude into the hollow cavity 326 of the support element 302. In some implementations, the locations of the sensors 310A-310F on the fairing portions 312A-312C and the protrusion of the sensors 310A-310F into the hollow cavity may result in reduced side forces acting on the logging tool 300 during rotation of the support element 302. Furthermore, such a structural configuration may allow for a greater reduction in side forces than the configuration depicted and described with reference to FIGS. 2A-2B.

Moreover, it will be appreciated that in certain embodiments, any component of the logging tool 300 that does not form a surface of revolution may also be positioned symmetrically across the support element 302. For instance, the sensor housings 322A-322F may also be positioned symmetrically across the support element 302. As such, symmetrical placements of these components may facilitate the reduction of side forces and moments that may be experienced by the logging tool 300 during logging.

It will be appreciated that the logging tool 300 depicted in FIG. 3 may include any number of sensors 310A-310F, fairing portions 312A-312C, sensor housings 322A-322F, and sensor components 324A-324F in any combination. Furthermore, in some implementations, one or more of the sensors 310A-310F may be "dummy" sensors with no sensing or measurement-taking capabilities. Instead, the dummy sensors may be coupled to the logging tool 300 merely to provide a symmetrical balance to other functioning sensors 312A-312F in order to reduce side forces on the logging tool 300 during rotation of the support element 302.

In yet other implementations, the support element 302 may be adjustable in diameter. For example, while the logging tool 300 is entering or exiting a wellbore 116, the support element 302 may be adjusted to a relatively smaller diameter to facilitate ease of entry and/or exit. When the logging tool 300 begins taking measurements (e.g., resistivity measurements) in the wellbore 116, the support element 302 may be adjusted to a relatively larger diameter (e.g., relatively near to the diameter of the casing in the wellbore 116). As such, the logging tool 300 may be configured to dynamically adjust the diameter of the support element 302 depending on the position of the logging tool 300 within the wellbore 116.

Figure 4:
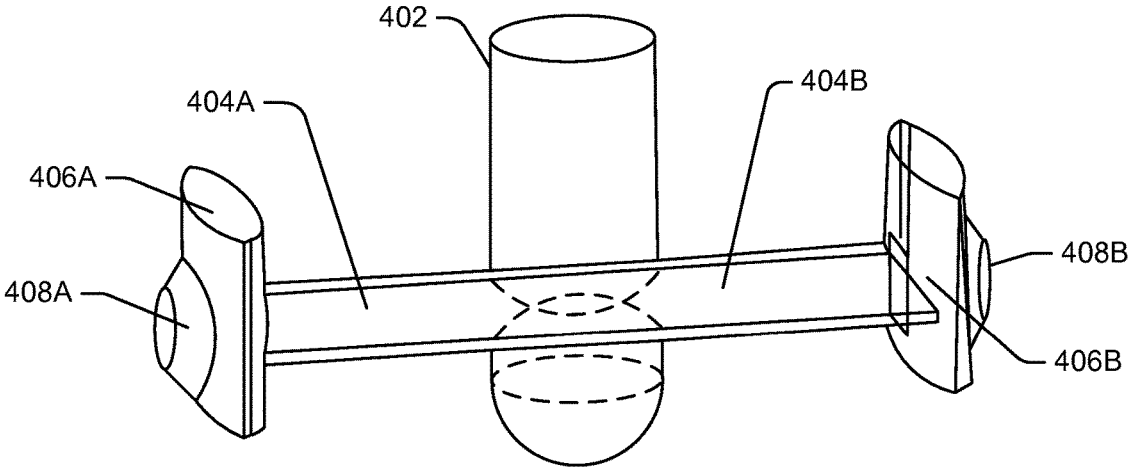
FIG. 4 illustrates a schematic diagram of yet another example rotating downhole logging tool in accordance with one or more example embodiments.

Referring now to FIG. 4, a schematic diagram of another logging tool 400 is illustrated in accordance with one or more example embodiments. The logging tool 400 may include a support element 402 and one or more support arms 404A-404B. The support arms 404A-404B may support one or more sensor attachments 406A-406B, which may be respectively coupled to one or more sensors 408A-408B. In certain embodiments, the sensor attachments 406A-406B may be hydro-dynamically smooth structures configured to reduce the driving torque used to rotate the support element 402 in a well (e.g., wellbore 116). In other implementations, one or more turbine blades may be coupled to one or more portions of the logging tool 400 to also reduce the driving torque.

Figure 5:
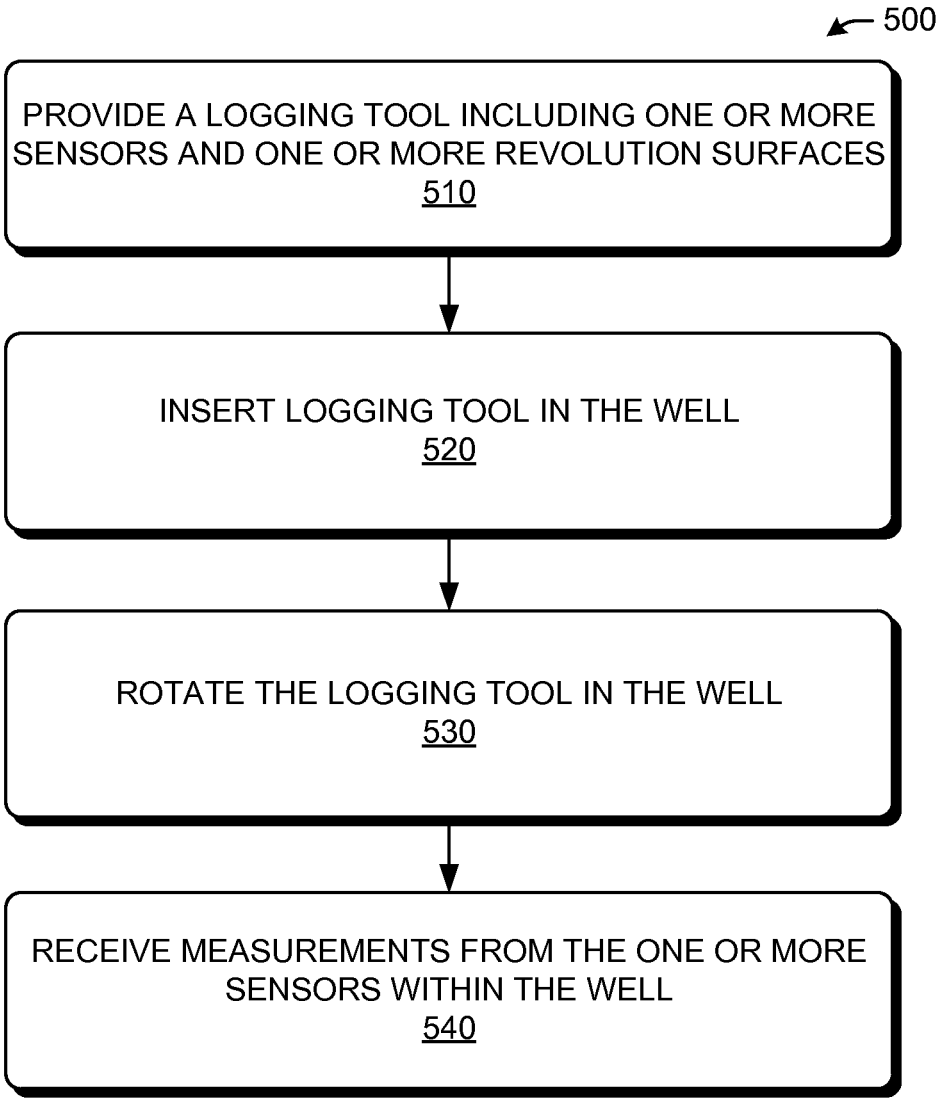
FIG. 5 illustrates a flow diagram of an example method for reducing torque on a rotating downhole logging tool in accordance with one or more example embodiments.

Referring now to FIG. 5, a flow diagram of a method 500 is depicted for reducing torque and/or side forces on a logging tool while rotating in a well. The method 500 may being in block 510, in which a logging tool (e.g., logging tool 200 in FIG. 2A) is provided. The logging tool 200 may include one or more sensors (e.g., sensors 210A-210D) and one or more fairing portions (212A-212C) or revolution surfaces to reduce fluidic resistance of the logging tool 200 when the tool 200 is within a well (e.g., wellbore 116). Furthermore, the logging tool 200 may be configured to permit fluid to flow through the tool 200 when the tool 200 is in the well. In block 520, the logging tool 200 may be inserted into the well, and in block 530, the logging tool 200 may be rotated in the well. In block 540, measurements from the one or more sensors 210A-210D in the well may be received.

The operations and processes described and shown above may be carried out or performed in any suitable order as desired in various implementations. Additionally, in certain implementations, at least a portion of the operations may be carried out in parallel. Furthermore, in certain implementations, less than or more than the operations described may be performed. It will be understood that some or all of the blocks of the block diagrams and flow diagrams, and combinations of blocks in the block diagrams and flow diagrams, respectively, can be implemented by computer-executable program instructions.

These computer-executable program instructions may be loaded onto a special-purpose computer or other particular machine, a processor, or other programmable data processing apparatus to produce a particular machine, such that the instructions that execute on the computer, processor, or other programmable data processing apparatus create means for implementing one or more functions specified in the flow diagram block or blocks. These computer program instructions may also be stored in a computer-readable storage media or memory that can direct a computer or other programmable data processing apparatus to function in a particular manner, such that the instructions stored in the computer-readable storage media produce an article of manufacture including instruction means that implement one or more functions specified in the flow diagram block or blocks. As an example, certain implementations may provide for a computer program product, comprising a computer-readable storage medium having a computer-readable program code or program instructions implemented therein, said computer-readable program code adapted to be executed to implement one or more functions specified in the flow diagram block or blocks. The computer program instructions may also be loaded onto a computer or other programmable data processing apparatus to cause a series of operational elements to be performed on the computer or other programmable apparatus to produce a computer-implemented process such that the instructions that execute on the computer or other programmable apparatus provide elements or operations for implementing the functions specified in the flow diagram block or blocks.

Conditional language, such as, among others, "can," "could," "might," or "may," unless specifically stated otherwise, or otherwise understood within the context as used, is generally intended to convey that certain implementations could include, while other implementations do not include, certain features, elements, and/or operations. Thus, such conditional language is not generally intended to imply that features, elements, and/or operations are in any way used for one or more implementations or that one or more implementations necessarily include logic for deciding, with or without user input or prompting, whether these features, elements, and/or operations are included or are to be performed in any particular implementation.

Many modifications and other implementations of the disclosure set forth herein will be apparent having the benefit of the teachings presented in the foregoing descriptions and the associated drawings. Therefore, it is to be understood that the disclosure is not to be limited to the specific implementations disclosed and that modifications and other implementations are intended to be included within the scope of the appended claims. Although specific terms are employed herein, they are used in a generic and descriptive sense and not for purposes of limitation.

The invention claimed is:

1. A downhole logging tool comprising:

a support element comprising a hollow cavity, the support element configured to rotate about an axis of a well when the support element is inserted in the well, wherein the hollow cavity has a longitudinal axis situated about the axis of the well when the support element is in the well, and the hollow cavity configured to permit fluid flow from the well through an opening of the support element when the support element is in the well; and a first fairing portion comprising a first sensor to obtain measurements in the well, wherein the first fairing portion is arranged on the support element so as to protrude from the support element and is configured to form a revolution surface extending about the whole perimeter of the support element and associated with a portion of the support element to reduce fluidic resistance of the rotating support element.

2. The downhole logging tool of claim 1, wherein the first sensor is substantially embedded within the first fairing portion.

3. The downhole logging tool of claim 1, further comprising:

a second fairing portion comprising another revolution surface extending about the whole perimeter of the support element associated with the support element; and the second fairing portion comprising a second sensor to obtain measurements in the well.

4. The downhole logging tool of claim 1, wherein the first fairing portion comprises a second sensor, wherein the first sensor and the second sensor are located on opposing surfaces of the first fairing portion.

5. The downhole logging tool of claim 4, wherein the first sensor and the second sensor partially protrude into the hollow cavity.

6. The downhole logging tool of claim 1, wherein the support element comprises an upper portion and a lower portion, the upper portion comprising the opening into the hollow cavity.

7. The downhole logging tool of claim 1, wherein the support element is substantially cylindrical, and the first fairing portion is frustoconical in shape.

8. The tool of claim 7, wherein the sensor is situated on a chamfered portion of the first fairing portion.

9. The tool of claim 1, configured to be conveyed in the well via a cable.

10. A system comprising:

a data processing component configured to receive one or more measurements; and a logging tool comprising:

a support element comprising a hollow cavity, the support element configured to rotate about an axis of a well when the support element is inserted in the well, wherein the hollow cavity has a longitudinal axis situated about the axis of the well when the support element is in the well, and the hollow cavity configured to permit fluid flow from the well through an opening of the support element when the support element is in the well; and a first fairing portion comprising a first sensor to obtain measurements in the well, wherein the first fairing portion is arranged on the support element so as to protrude from the support element and is configured to form a revolution surface extending about the whole perimeter of the support element and associated with a portion of the support element to reduce fluidic resistance of the rotating support element.

11. The system of claim 10, wherein the first sensor is substantially embedded within the first fairing portion.

12. The system of claim 10, further comprising:

a second fairing portion forming another surface of revolution around the support element extending about the whole perimeter of the support element; and a second sensor included in the second fairing portion.

13. The system of claim 10, wherein the first fairing portion comprises a second sensor, wherein the first sensor and the second sensor are positioned on opposing surfaces of the first fairing portion.

14. The system of claim 13, wherein the first sensor and the second sensor partially protrude into the hollow cavity.

15. The system of claim 10, wherein the support element comprises an upper portion and a lower portion, the upper portion comprising an opening into the hollow cavity.

16. The system of claim 15, wherein the support element is substantially cylindrical, and the first fairing portion is frustoconical in shape.

17. A method comprising:

providing a logging tool, wherein the logging tool includes:

a support element comprising a hollow cavity, the support element configured to rotate about an axis of a well when the support element is inserted in the well, wherein the hollow cavity has a longitudinal axis situated about the axis of the well when the support element is in the well, and the hollow cavity configured to permit fluid flow from the well through an opening of the support element when the support element is in the well; and a first fairing portion comprising a first sensor to obtain measurements in the well, wherein the first fairing portion is arranged on the support element so as to protrude from the support element and is configured to form a revolution surface extending about the whole perimeter of the support element and associated with a portion of the support element to reduce fluidic resistance of the rotating support element;

inserting the tool in the well;

rotating the tool in the well; and obtaining measurements from the one or more sensors.

18. The method of claim 17, wherein the first sensor is substantially embedded within the one or more revolution surfaces.

19. The method of claim 17, wherein the logging tool comprises a hollow cavity, and wherein the one or more sensors are configured to protrude partially into the hollow cavity.

* * * * *